United States Patent [19]

Oswald et al.

[11] Patent Number: 4,646,387

[45] Date of Patent: Mar. 3, 1987

[54] ARRANGEMENT FOR CONTINUOUSLY DETERMINING THE DENSITY OF A WEB OF FIBER SLIVER

[75] Inventors: Peter Oswald, Matzingen; Victor Pietrini, Wiezikon, both of Switzerland

[73] Assignee: Maschinenfabrik Rieter AG, Winterthur, Switzerland

[21] Appl. No.: 829,811

[22] Filed: Feb. 14, 1986

[30] Foreign Application Priority Data

Feb. 15, 1985 [CH] Switzerland ..... 719/85

[51] Int. Cl.[4] ..... D01G 23/06

[52] U.S. Cl. ..... 19/0.23; 19/105; 19/240; 19/300

[58] Field of Search ..... 19/0.23, 0.24, 105, 19/240, 300; 73/159, 160

[56] References Cited

U.S. PATENT DOCUMENTS

| | | | |
|---|---|---|---|
| 3,709,406 | 1/1973 | Binder et al. | 19/105 X |
| 3,796,094 | 3/1974 | Cook et al. | 73/159 |
| 4,030,635 | 6/1977 | Hablutzel et al. | 19/105 X |
| 4,068,385 | 1/1978 | Mitzel | 73/159 X |
| 4,095,063 | 6/1978 | Herzhoff et al. | 19/0.24 X |
| 4,506,413 | 3/1985 | Leifeld | 19/105 |

FOREIGN PATENT DOCUMENTS

| | | |
|---|---|---|
| 1265631 | 11/1968 | Fed. Rep. of Germany . |
| 2031012 | 11/1970 | France . |
| 2211549 | 7/1974 | France . |
| 0490526 | 6/1970 | Switzerland . |
| 0957625 | 5/1964 | United Kingdom . |
| 2061338 | 5/1981 | United Kingdom . |

*Primary Examiner*—Louis K. Rimrodt
*Attorney, Agent, or Firm*—Michael J. Striker

[57] ABSTRACT

An arrangement for continuously determining the density of an elongated strip-shaped web of fiber sliver in the course of a spinning process in order to generate control signals for use in controlling the operation of machine elements operative for equalizing the distribution of the fiber sliver includes two of stepped rollers which together delimit, at a their nip region, a confining space for the passage of the fiber sliver web therethrough. One of the rollers is mounted on a support for rotation about a stationary axis and is driven in rotation, while the other roller is mounted on the support for free rotation about another axis which is parallel to the stationary axis and defines an imaginary plane therewith, as well as for movement along the imaginary plane against a spring force away from the one roller, so that the fiber sliver is compressed and moves the other roller to a greater or lesser degree away from the one roller as it passes through the confining space, depending on its density. A contactless proximity sensing element is arranged along the imaginary plane and has a sensing surface which faces a portion of the peripheral surface of the other roller so as to detect the extent of displacement of the other roller relative to the one roller and issue an electric signal representative of the detected value.

9 Claims, 5 Drawing Figures

1
11
3
9
20
23
5
2
19
17
18
14
101
E
22
121
21
15
7
13
12
131
1
F
8

101; 131
9
15
16
M
L
121
S
18
19
14
10
5
6
22
2
II
II
21
3
20
15
14
17
11
4
T
7

1
3
20
9
23
18
A
5
2
22
E
21
19
M
1

ARRANGEMENT FOR CONTINUOUSLY DETERMINING THE DENSITY OF A WEB OF FIBER SLIVER

BACKGROUND OF THE INVENTION

The present invention relates to measuring or sensing arrangements in general, and more particularly to an arrangement for continuously determining the cross section or mass of an elongated strip-shaped web of fiber sliver.

There are already known various arrangements of the above type, among them such in which the web passes through a nip between two sensing rollers, one of which is mounted for rotation about a stationary axis and is driven in rotation, while the other is mounted for free rotation about another axis which is parallel to the stationary axis and defines an imaginary plane therewith, and for movement along the imaginary plane against a spring force away from the one roller, and in which sensing means senses the extent of movement of the other roller relative to the one roller.

So, for instance, the published German patent application DE-AS No. 12 65 631 discloses a drafting arrangement in which fiber sliver is guided between a driven roller rotating about a stationary axis and an additional roller which can be pressed against the driven roller and is frictionally entrained for rotation about another axis. A pulse generator, which is not described in any detail in this published application, engages the additional roller and generates a signal in dependence on the movement of this additional roller, this signal being supplied to control means which is operative for correspondingly varying the rotational speed of the driven roller.

This particular known arrangement has several disadvantages, one of which is that the engagement of the pulse generator with the additional roller causes friction which results in wear of the sensing surface of the pulse generator. Another drawback of this known arrangement is that error measurements may result if foreign particles or bodies pass between the sensing surface of the pulse generator and the associated surface of the additional roller. This is particularly true if the foreign particles or bodies are of a smearable, layer-forming type. Such error measurements can remain undetected over a long period of time, thus producing undesirable faults in the yarn count over a considerable length of the produced yarn.

SUMMARY OF THE INVENTION

Accordingly, it is a general object of the present invention to avoid the disadvantages of the prior art.

More particularly, it is an object of the present invention to provide an arrangement for determining the density of an elongated web of fiber sliver, which arrangement does not possess the disadvantages of the known arrangements of this kind.

Still another object of the present invention is so to construct the arrangement of the type here under consideration as to avoid the occurrence of disturbances in the sensing to the greatest possible extent.

A concomitant object of the present invention is so to construct the arrangement of the above type as to be relatively simple in construction, inexpensive to manufacture, easy to use, and reliable in operation nevertheless.

In pursuance of these objects and others which will become apparent hereafter, one feature of the present invention resides in an arrangement for continuously determining the density of an elongated web of fiber sliver, comprising a support; a pair of rollers having respective peripheral surfaces which receive the elongated web between themselves and including a driven roller mounted on the support for rotation about a stationary axis and an additional roller mounted on the support for rotation about an additional axis which is parallel to the stationary axis and defines an imaginary plane therewith, and for movement along the imaginary plane toward and away from the driven roller; means for urging the additional roller toward the driven roller to confine the web between the peripheral surfaces of the rollers and to frictionally entrain the additional roller for rotation about the additional axis; and means for sensing the extent of movement of the additional roller along the imaginary plane and thus the instantaneous density of the fiber sliver web confined between the peripheral surfaces of the rollers, including a contactless sensing element having a sensing surface which is situated substantially at the imaginary plane and faces the peripheral surface of the additional roller.

According to another advantageous aspect of the present invention, the arrangement further comprises means for so mounting the sensing element and the additional roller on the support that the measuring results obtained from the sensing element are virtually uninfluenced by changes in the temperature of the arrangement. It is further advantageous when the mounting means for the sensing element and for the additional roller includes support elements which extend substantially normal to the imaginary plane.

In a particularly advantageous construction of the arrangement of the present invention, the sensing element is arranged next to the driven roller. Then, it is further advantageous when the driven roller is mounted on a shaft which is centered on the stationary axis, and when the shaft and that one of the support elements which supports the sensing element are arranged one after the other as considered in the axial direction of the shaft. In this context, it is also advantageous when the one support element has a plane of symmetry which coincides with an additional imaginary plane which includes the stationary axis and extends normal to the imaginary plane.

According to another facet of the present invention, the support elements for the additional roller are leaf springs each having a predetermined width and so arranged with their widths extending parallel to the additional axis of the additional roller that the movements of the additional roller occur in a frictionless manner. It is also proposed by the present invention for the urging means to include respective springs each so arranged at one axial side of the additional roller that the force transmission therefrom occurs in a frictionless manner. Last but not least, it is advantageous when the rollers of the pair are constructed as stepped rollers.

The novel features which are considered as characteristic of the invention are set forth in particular in the appended claims. The improved arrangement for detecting the density of a web of fiber sliver itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
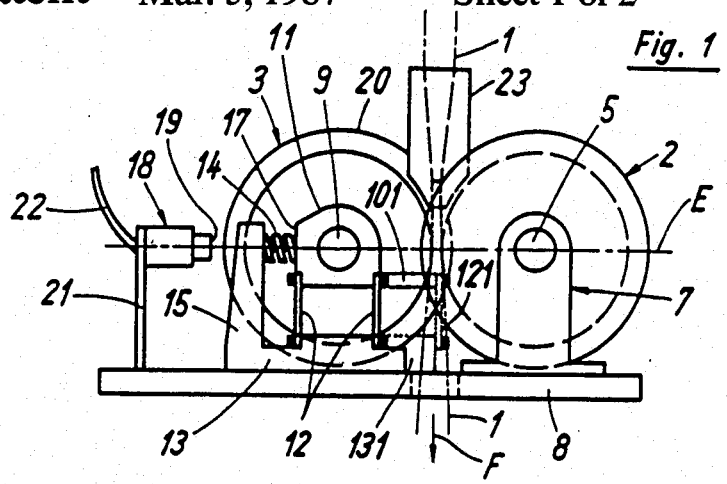
FIG. 1 is a somewhat simplified side elevational view of an arrangement according to the present invention.

Referring now to the drawing in detail, and first to FIG. 1 thereof, it may be seen that the reference numeral 1 has been used therein to identify a body or web of fiber sliver. A device for continuously sensing the cross section or mass, which will be collectively referred to herein as density for the sake of simplification, of the body 1 of fiber sliver comprises a measuring roller pair consisting of a driven roller 2 and another roller 3 which is dragged along with the driven roller 2, that is, caused to rotate by frictional entrainment. Rollers such as the rollers 2 and 3 depicted in the drawings are often referred to as stepped rollers and they penetrate into each other in such a manner (see FIG. 2) that a defined space 4 is provided for measuring the sliver cross section or the sliver mass. The driven roller 2 is driven by a shaft 5 to which it is secured for rotation therewith. The shaft 5 is supported on the two axial sides of the roller 2 in respective bearings 6 and 7 in a practically play-free manner. The bearings 6 and 7 are in turn secured to a base plate 8.

The friction-driven roller 3 is fixed to a shaft 9 for rotation therewith. The shaft 9 is rotatably supported on the two sides of the roller 3 in respective bearings 10 and 11 in a practically play-free manner. This friction-driven roller 3 is movable in the directions of an arrow M in order to be able to measure the cross section or the mass of the fiber sliver located in the space or chamber 4. These movements take place through fractions of a millimeter. In order to enable such movement in a friction-free manner, the bearings 10 and 11 (in FIG. 1, only the bearing 11 is visible) are secured by respective leaf springs 12 to a carrier 13 secured to the base plate 8 (in FIG. 1, only the carrier 13 for the bearing 11 is visible). These leaf springs 12, which are arranged as spring-legs, are loaded in a transport direction F (FIG. 1) of the fiber sliver body 1 in longitudinal compression, tending to cause buckling, and are subjected to a bending load in the directions of movement M; they are to be dimensioned so that buckling is avoided.

In order to be able to measure the sliver cross section without letting air into the chamber 4, the fiber sliver must be condensed in this chamber 4. In order to obtain such condensing, the bearings 10 and 11 of the friction-driven roller 3 are each subjected to a pressure produced by a respective compression spring 14 acting with a predetermined force. In this way, the roller 3 is pressed against the roller 2. The springs 14 are mounted on an arm 15 (only one of which can be seen in FIG. 1) which is associated with the carrier 13; they press against those surfaces 16 and 17 of the bearings 10 and 11 which respectively face the arm 15.

Figure 2:
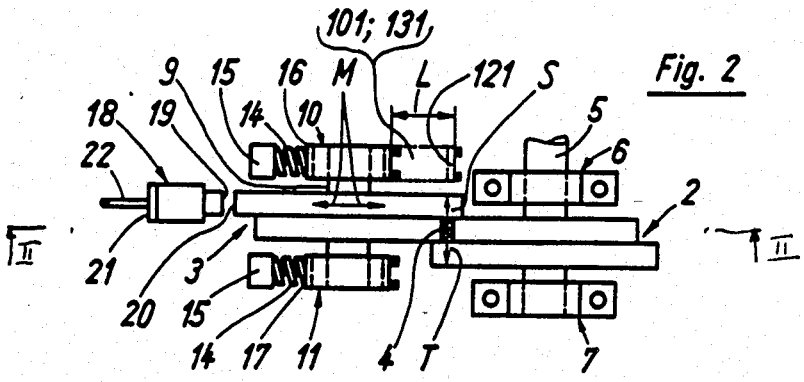
FIG. 2 is a partial top plan view of the arrangement of FIG. 1.

Due to the pressure generated in the previously mentioned chamber 4, forces arise not only in the bending direction of the leaf springs 12, that is, at right angles to the axes of rotation of the sensing rollers 2 and 3, but also parallel to these axes of rotation, that is in the directions indicated by S and T in FIG. 2. The force in the direction T is transferred by the driven roller 2 via the shaft 5 to the bearings 6 and 7, so that, as a result of the stationary and non-elastic arrangement of these bearings 6 and 7, the driven roller 2 is not shifted by the force in the direction T. On the other hand, it is known that the resistance moment of leaf springs at a right angle to their bending direction is much greater than the resistance moment in their bending direction. This means that the leaf springs 12 quite readily yield in the direction of movement M but are very stiff in the pressure direction S. The mounting of the bearings 10 and 11 on the leaf springs 12 therefore has the advantage that even the movable roller 3 is not shifted by the force acting in the direction S.

In spite of this, the bearing 10 may be provided with a cantilevered extension 101 of a length L and the associated carrier 13 may have an extension 131 with the same overhang L, as indicated in phantom lines in FIGS. 1 and 2. In this way, one of the two leaf springs provided for this bearing 10 and indicated at 121 can be provided at a region at which the force in the direction S exerts a substantially zero moment on the movable roller 3. The length L can be selected larger or smaller in dependence upon the choice of the resistance moment of the leaf spring 121.

Figure 3:
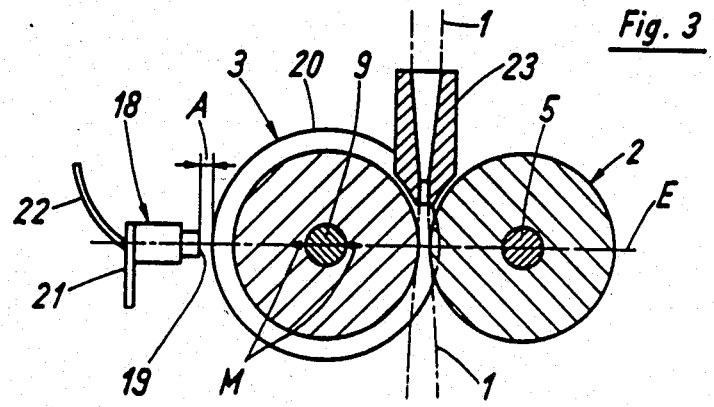
FIG. 3 is a sectional view taken on line II—II of FIG. 2.

In order to be able to measure the movements of the friction-driven roller 3 in the aforementioned directions M, a sensor 18 with a sensing surface 19 (shown in FIG. 3) is arranged opposite a peripheral surface 20 of the friction-driven roller 3 without contacting the surface 20. The arrangement is such that the center of this sensing surface 19 lies substantially in an imaginary plane E (compare FIGS. 1 and 3) containing the axes of rotation (not indicated) of the driven roller 2 and of the friction-driven roller 3.

The sensor 18 is, for example, a known type of eddy current sensor and is secured by means of a stator 21 to the base plate 8. The sensor 18 is connected by a connector lead 22 with the associated detector (not shown). The stator 21 is arranged substantially at right angles to the base plate 8.

In operation, the body 1 of sliver is moved in the transport direction F by means of the driven roller 2 due to the condensing of the sliver in the chamber 4 that is caused by the compression springs 14. In this way, the friction-driven roller 3 is caused to move in the directions M in response to changes in the mass of the sliver. In response to these movements, a spacing A between the sensing surface 19 and the sensed peripheral surface 20 of the friction-driven roller 3 varies over the above-mentioned fractions of a millimeter; this is sensed by the sensor 18 and this information is transferred as a voltage signal to the non-illustrated detector and thereafter is used as a control signal for example to control the rotational speed of drafting rollers or the rotational speed of a feed roller at the infeed to a card.

Due to the contactless sensing of the linear movements of the friction-driven roller 3 in the plane E, there is obtained the advantage that mass variations in the sliver can be detected by the sensor 18 in an analogously linear fashion.

Figure 4:
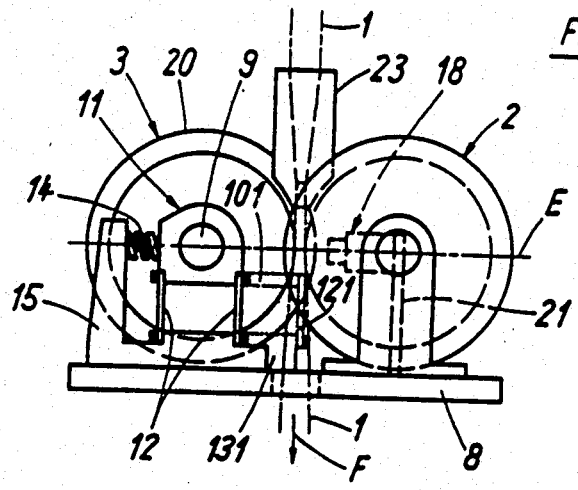
FIG. 4 is a view similar to that of FIG. 1 but showing a modified arrangement of the present invention.
Figure 5:
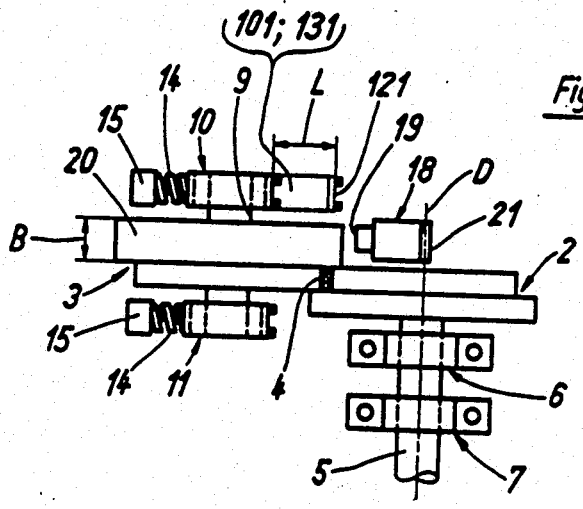
FIG. 5 is a partial top plan view of the modified arrangement of FIG. 4.

A modified construction which is illustrated in FIGS. 4 and 5 can be used in order to avoid to the largest possible extent the occurrence of error measurements due to varying temperature expansion of the elements employed. Those elements which are the same as or similar to those employed in FIGS. 1 and 3 have been identified by the same reference numerals in FIGS. 4 and 5. An important feature of this modified construction is that the sensor 18 is arranged on the opposite side, that is, close and parallel to the driven roller 2; this makes the following adjustments necessary relative to the device of FIGS. 1 to 3:

1. The driven roller 2 is provided with a so-called cantilever mounting, as indicated in FIG. 5, so that the bearings 6 and 7 which support the shaft 5 are arranged on the same side of the roller 2.

2. The sensor 18 is mounted by means of the stator 21 on the side of the driven roller 2 which is opposite to the shaft 5; this arrangement is advantageous in that the stator 21 and the shaft 5 are arranged one after the other as viewed in the axial direction of the shaft 5. In a maximum arrangement, the corresponding plane of symmetry (not shown) of the stator 21 would coincide with an imaginary plane D containing the axis of rotation of the shaft 5 and extending at right angles to the previously mentioned plane E.

3. Depending on the dimensions of the sensor 18, the width B (FIG. 5) of the peripheral surface 20 must be increased to ensure sensing on the entire sensing surface 19 of the sensor 18.

This modification has the advantage that, in the advantageous arrangement, a temperature expansion of the base plate 8 which differs from that of the rollers 2 and 3 has practically no influence on the spacing A between the peripheral surface 20 and the sensing surface 19, and in the aforementioned maximum arrangement, the differing temperature expansion has no influence at all upon the spacing A.

Flat steel profiles of corresponding buckling resistance and elasticity and with an adequate resistance moment can be selected in place of the leaf springs in order to adequately resist to force in the direction S. The actual dimensioning of the leaf springs or flat steel profiles is a question of design and must be determined from case to case.

A funnel 23 of a known type is used for the guidance of the body 1 of fiber sliver into the chamber 4 between the rollers 2 and 3.

It will be understood that each of the elements described above, or two or more together, may also find a useful application in other types of arrangements differing from the type described above.

While the invention has been illustrated and described as embodied in a an arrangement for continuously sensing the density of a body of fiber sliver, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims; we claim:

1. An arrangement for continuously determining the density of an elongated web of fiber sliver, comprising a support; a pair of rollers having respective peripheral surfaces which receive the elongated web between themselves and including a driven roller mounted on said support for rotation about a stationary axis and an additional roller mounted on said support for rotation about an additional axis which is parallel to said stationary axis and defines an imaginary plane therewith, and for movement along said imaginary plane toward and away from said driven roller; means for urging said additional roller toward said driven roller to confine the web between said peripheral surfaces of said rollers and to frictionally entrain said additional roller for rotation about said additional axis; and means for sensing the extent of movement of said additional roller along said imaginary plane and thus the instantaneous density of the fiber sliver web confined between said peripheral surfaces of said rollers, including a contactless sensing element having a sensing surface which is situated substantially at said imaginary plane and faces said peripheral surface of said additional roller to defined therewith a gap having a size which varies proportionately to said movement of said additional roller along said imaginary plane, said sensing element being operative for measuring said varying size of said gap.

2. The arrangement as defined in claim 1, and further comprising means for so mounting said sensing element and said additional roller on said support that said size of said gap and thus the measuring results obtained from said sensing element are virtually independent of changes in the temperature of the arrangement.

3. The arrangement as defined in claim 2, wherein said mounting means for said sensing element and for said additional roller includes support elements which extend substantially normal to said imaginary plane.

4. The arrangement as defined in claim 3, wherein said sensing element is arranged next to said driven roller.

5. The arrangement as defined in claim 4, wherein said driven roller is mounted on a shaft which is centered on said stationary axis; and wherein said shaft and that one of said support elements which supports said sensing element are arranged one after the other as considered in the axial direction of said shaft.

6. The arrangement as defined in claim 5, wherein said one support element has a plane of symmetry which coincides with an additional imaginary plane which includes said stationary axis and extends normal to said imaginary plane.

7. The arrangement as defined in claim 3, wherein said support elements for said additional roller are leaf springs each having a predetermined width and so arranged with their widths extending parallel to said additional axis of said additional roller that the movements of said additional roller occur in a frictionless manner.

8. The arrangement as defined in claim 3, wherein said urging means includes respective springs each so arranged at one axial side of said additional roller that the force transmission therefrom occurs in a frictionless manner.

9. The arrangement as defined in claim 1, wherein said rollers of said pair are constructed as stepped rollers.

* * * * *